US011171398B2

(12) United States Patent
Odagiri

(10) Patent No.: US 11,171,398 B2
(45) Date of Patent: Nov. 9, 2021

(54) ELECTRONIC DEVICE

(71) Applicant: Sony Interactive Entertainment Inc., Tokyo (JP)

(72) Inventor: Kazuya Odagiri, Kanagawa (JP)

(73) Assignee: Sony Interactive Entertainment Inc., Tokyo (JP)

( * ) Notice: Subject to any disclaimer, the term of this patent is extended or adjusted under 35 U.S.C. 154(b) by 183 days.

(21) Appl. No.: 16/482,183

(22) PCT Filed: Feb. 14, 2017

(86) PCT No.: PCT/JP2017/005337
§ 371 (c)(1),
(2) Date: Jul. 30, 2019

(87) PCT Pub. No.: WO2018/150468
PCT Pub. Date: Aug. 23, 2018

(65) Prior Publication Data

US 2020/0044302 A1 Feb. 6, 2020

(51) Int. Cl.
*H01P 3/06* (2006.01)
*H01Q 1/50* (2006.01)

(52) U.S. Cl.
CPC ..... *H01P 3/06* (2013.01); *H01Q 1/50* (2013.01); *H01R 2201/02* (2013.01)

(58) Field of Classification Search
CPC .... H01P 3/06; H01P 3/10; H01Q 1/50; H01R 2201/02
See application file for complete search history.

(56) References Cited

U.S. PATENT DOCUMENTS

| | | | | |
|---|---|---|---|---|
| 5,764,193 | A | 6/1998 | Uchino | |
| 6,917,333 | B2 | 7/2005 | Ikegaya | |
| 9,300,037 | B2 | 3/2016 | Hiroiku | |
| 2003/0090425 | A1 | 5/2003 | Ikegaya | |
| 2012/0280879 | A1 | 11/2012 | Zimmerman et al. | |
| 2013/0082898 | A1* | 4/2013 | Asanuma | H01Q 9/40 343/893 |
| 2014/0176391 | A1* | 6/2014 | Tayama | H01Q 1/50 343/905 |
| 2015/0054702 | A1* | 2/2015 | Rogers | H01Q 13/08 343/753 |

FOREIGN PATENT DOCUMENTS

| | | | |
|---|---|---|---|
| CN | 1417886 | A | 5/2003 |
| CN | 102959802 | A | 3/2013 |
| CN | 103703618 | A | 4/2014 |
| JP | 61099402 | | 5/1986 |

(Continued)

OTHER PUBLICATIONS

Notice of Reasons for Refusal for corresponding JP Application No. 2019-500071, 5 pages, dated Oct. 8, 2020.

(Continued)

*Primary Examiner* — Jimmy T Vu
(74) *Attorney, Agent, or Firm* — Matthew B. Dernier, Esq.

(57) ABSTRACT

Disclosed herein is an electronic device including a coaxial cable connected to an antenna and a conductive body having a strip-like shape and being electrically coupled to an external conductor of the coaxial cable, an end of the conductive body not being electrically connected other conductive members.

11 Claims, 15 Drawing Sheets

(56) References Cited

FOREIGN PATENT DOCUMENTS

| | | | |
|---|---|---|---|
| JP | 62177106 | | 11/1987 |
| JP | 10233619 | A | 9/1998 |
| JP | 11340710 | A | 12/1999 |
| JP | 3165653 | B2 * | 5/2001 |
| JP | 3165653 | B2 | 5/2001 |
| JP | 2004343193 | A | 12/2004 |
| JP | 2005191792 | A | 7/2005 |
| JP | 2011142414 | A | 7/2011 |
| JP | 2015073239 | A | 4/2015 |
| WO | 2013047033 | A1 | 4/2013 |

OTHER PUBLICATIONS

Office Action for corresponding CN Application No. 201780085886.6, 16 pages, dated Aug. 24, 2020.
International Preliminary Report on Patentability and Written Opinion for corresponding PCT Application No. PCT/2017/005337, 11 pages, dated Aug. 29, 2019.
International Search Report for corresponding PCT Application No. PCT/2017/005337, 4 pages, dated Mar. 21, 2017.
Extended European Search Report for corresponding EP Application No. 17896773.3, 44 pages, dated Sep. 28, 2020.
Decision to Grant a Patent for corresponding JP Application No. 2019-500071, 5 pages, dated Apr. 12, 2021.
The Second Office Action for corresponding CN Application No. 201780085886.6, 19 pages, dated Apr. 20, 2021.

* cited by examiner d=50mm d=75mm d=90mm

ELECTRONIC DEVICE

TECHNICAL FIELD

The present invention relates to an electronic device including a coaxial cable connected to an antenna.

BACKGROUND ART

Some electronic devices include antennas for radio communication. Such electronic devices relay radio signals transmitted and received by the antennas through feeders, such as coaxial cables, connected to the antennas.

SUMMARY

Technical Problem

In such an electronic device according to the related art, electromagnetic waves radiating from the antenna sometimes propagate along an external conductor of the coaxial cable as a leakage current. The generation of such a leakage current causes electromagnetic waves to be radiated from the external conductor of the coaxial cable due to the influence of the antenna even. The electromagnetic waves radiated around the coaxial cable are undesirable because they may act as noise affecting circuit components disposed near the coaxial cable and other coaxial cables.

An object of the present invention, which has been conceived in consideration of the above-described circumstances, is to provide an electronic device that can reduce electromagnetic waves generated from a coaxial cable connected to an antenna.

Solution to Problem

An electronic device according to the present invention includes a coaxial cable connected to an antenna, and at least one conductive body having a strip-like shape and electrically coupled to an external conductor of the coaxial cable, one end of the conductive body not being electrically connected to a ground connected to the coaxial cable.

DESCRIPTION OF EMBODIMENTS

Embodiments of the present invention will now be described in detail with reference to the drawings.

First Embodiment

Figure 1:
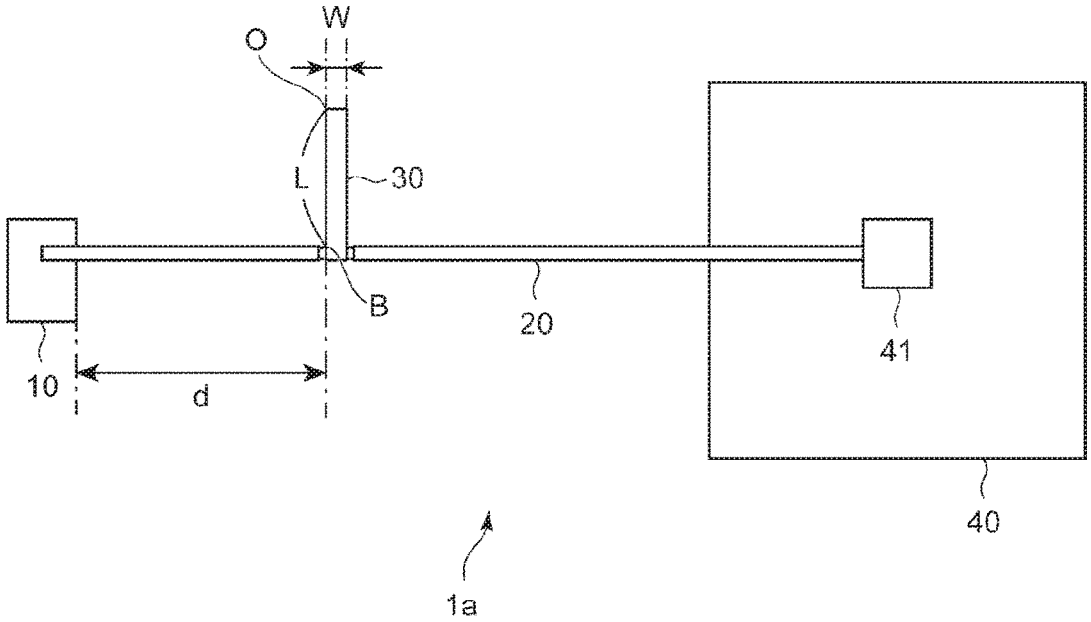
FIG. 1 illustrates the overall internal configuration of an electronic device according to a first embodiment of the present invention.

FIG. 1 is a schematic plan view of the overall internal configuration of an electronic device 1*a* according to a first embodiment of the present invention. The electronic device 1*a* is, for example, a personal computer, a stationary game console, a portable game console, or a smart phone, and includes an antenna 10, a coaxial cable 20, a conductive body 30, and a substrate 40 on which a radio frequency (RF) module 41 is mounted, as illustrated in FIG. 1.

The antenna 10 transmits and/or receives radio signals to establish radio communication between the electronic device 1 and other electronic devices. For example, the antenna 10 may be used for wireless local area network (LAN) communication or Bluetooth (registered trademark)

communication in accordance with the Institute of Electrical and Electronics Engineers (IEEE)802.11 standard.

Hereinafter, the representative frequency value used by the antenna 10 in radio communication is denoted as communication frequency f. The communication frequency f is the frequency of the radio signals transmitted and received by the antenna 10 and is determined in accordance with the standard of the radio communication. Note that, in general, the antenna 10 transmits and receives radio signals having frequencies in a predetermined frequency band. The communication frequency f in this case is defined by a median of the frequency band to be used. In specific, the communication frequency f is defined as f=(fmax+fmin)/2, where fmax is the maximum value in the frequency band used for radio communication by the antenna 10 and fmin is the minimum value.

The coaxial cable 20 includes an internal conductor passing through the center of the coaxial cable 20 and an external conductor surrounding the internal conductor. The coaxial cable 20 is used as a feeder for the antenna 10. In specific, an end portion of the coaxial cable 20 is electrically connected to the antenna 10 to serve as a relay between the antenna 10 and the RF module 41. Note that in the present embodiment, the antenna 10 is disposed outside the substrate 40. Thus, a portion of the coaxial cable 20 is also disposed outside the substrate 40.

When the antenna 10 transmits or receives a radio signal, a leakage current flows to the external conductor of the coaxial cable 20. This may cause the external conductor to radiate electromagnetic waves that act as noise to the surroundings. The electronic device 1*a* according to the present embodiment includes a conductive body 30 for suppressing radiation of electromagnetic waves from the external conductor.

The conductive body 30 is composed of a conductive material, such as sheet metal or copper foil tape, and has a thin strip-like shape. One end of the conductive body 30 is electrically connected to the external conductor of the coaxial cable 20 at a position outside the substrate 40. In detail, a portion of a covering of the external conductor of the coaxial cable 20 is removed at the connection with the conductive body 30 such that the one end of the conductive body 30 is fixed to the exposed external conductor. Hereinafter, the connection between the conductive body 30 and the external conductor of the coaxial cable 20 is referred to as base point B. The conductive body 30 is electrically connected with no other conductive member at positions other than base point B. The end of the conductive body 30 opposite the base point B (the end portion of the conductive body 30) is an open end. Hereinafter, the end of the conductive body 30 opposite the base point B is referred to as an open end O. More specifically, the base point B is defined to be an end point closest to the antenna 10 and adjacent to the open end O in the area in which the conductive body 30 is in contact with the external conductor of the coaxial cable 20. The open end O is defined to be an end point adjacent to the antenna 10 in the end portion of the conductive body 30 farthest from the coaxial cable 20.

In the present embodiment, the conductive body 30 has a substantially linear shape and extends in a direction substantially orthogonal to the extending direction of the coaxial cable 20. The length from the base point B to the open end O of the conductive body 30 is determined in accordance with the wavelength of the electromagnetic waves of which radiation is to be suppressed. Hereinafter, the path length L is defined as the physical length from the base point B to the open end of the conductive body 30. More specifically, the path length L is defined to be the length along the outer circumference of the conductive body 30 from the base point B to the open end O of the conductive body 30 on the side adjacent to the antenna 10. The electrical length Le is defined to be the electrical length of the conductive body 30 from the base point B to the open end O corresponding to the path length L.

It is preferred that the path length L of the conductive body 30 be determined such that the electrical length Le approximates $Le=(1/4+n/2)\lambda$, where $\lambda$ is the wavelength of the electromagnetic waves corresponding to the communication frequency f of the antenna 10 and n is an integer larger than or equal to zero. More specifically, it is preferred that the electrical length Le of the conductive body 30 satisfy $(1/8+n/2)\lambda \leq Le \leq (3/8+n/2)\lambda$. In this way, electromagnetic waves having a wavelength $\lambda$ propagating from the antenna 10 can be efficiently suppressed. The electrical length Le of the conductive body 30 matches the path length L unless the conductive body 30 is disposed in contact with a dielectric body, such as resin material. Thus, the path length L of the conductive body 30 should be within the range mentioned above. In the case where the conductive body 30 is disposed in contact with a dielectric body, the electrical length Le is larger than the actual path length L. Thus, the dimensions of the conductive body 30 can be reduced.

It is preferred that a width W of the conductive body 30 in the lateral direction (i.e., the direction along the extending direction of the coaxial cable 20) be sufficiently smaller than $\lambda/4$. Thus, it is preferred that the width W be at least ½ or less of the path length L of the conductive body 30.

The conductive body 30 may be connected to the coaxial cable 20 at a position a certain distance from the antenna 10. Hereinafter, the length of the coaxial cable 20 from the antenna 10 to the position where the conductive body 30 is connected (the position of the base point B) is denoted by distance d. In the present embodiment, the distance d is larger than $\lambda/4$. The presence of the conductive body 30 suppresses the generation of electromagnetic waves at a portion of the coaxial cable 20 on a side of the conductive body 30 opposite to the side of the antenna 10, regardless of the distance d.

Figure 2:
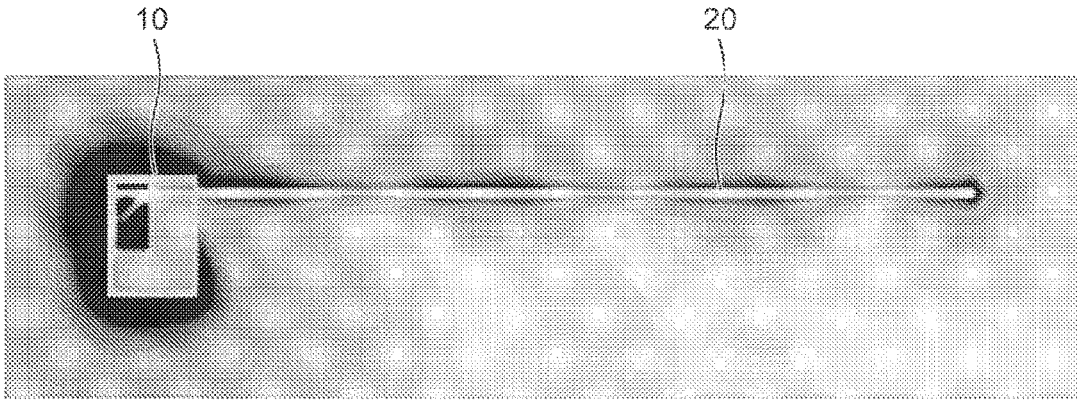
FIG. 2 illustrates an example distribution of electromagnetic waves when a conductive body according to an embodiment is absent.
Figure 3:
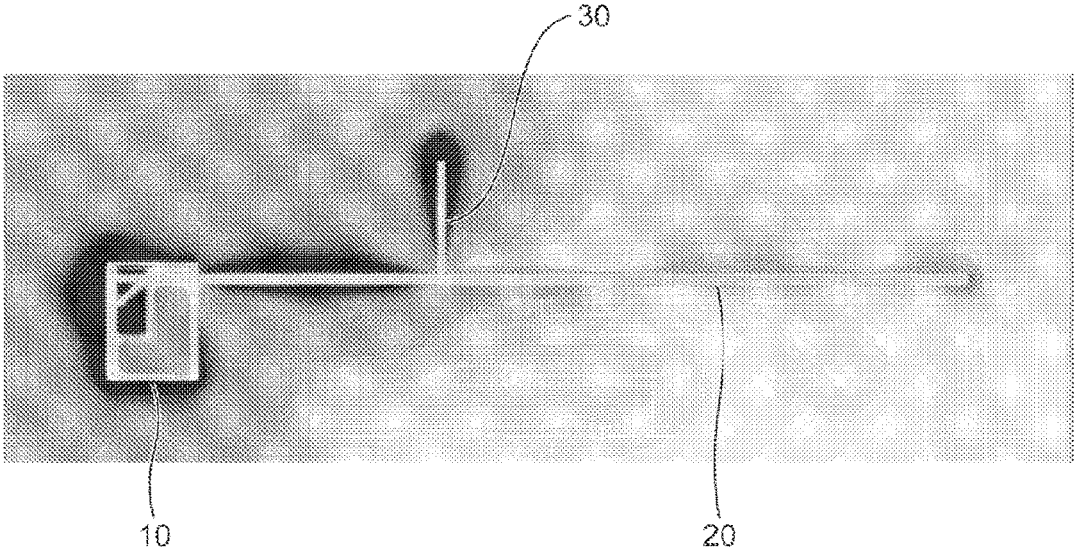
FIG. 3 illustrates an example distribution of electromagnetic waves when the conductive body is present.

FIGS. 2 and 3 each illustrates the effect of the conductive body 30 and the results of simulated distribution of electromagnetic waves radiated from the antenna 10 and the coaxial cable 20. In these drawings, the dark areas indicate radiation of intense electromagnetic waves. FIG. 2 illustrates a distribution of electromagnetic waves when the conductive body 30 is absent. FIG. 3 illustrates a distribution of electromagnetic waves when the conductive body 30 is present. With reference to FIG. 2, when the conductive body 30 is absent, electromagnetic waves are generated along the coaxial cable 20 even in areas far from the antenna 10. With reference to FIG. 3, when the conductive body 30 is present, the generation of electromagnetic waves is suppressed at a portion of the coaxial cable 20 on a side of the conductive body 30 opposite to the side of the antenna 10.

Figure 4:
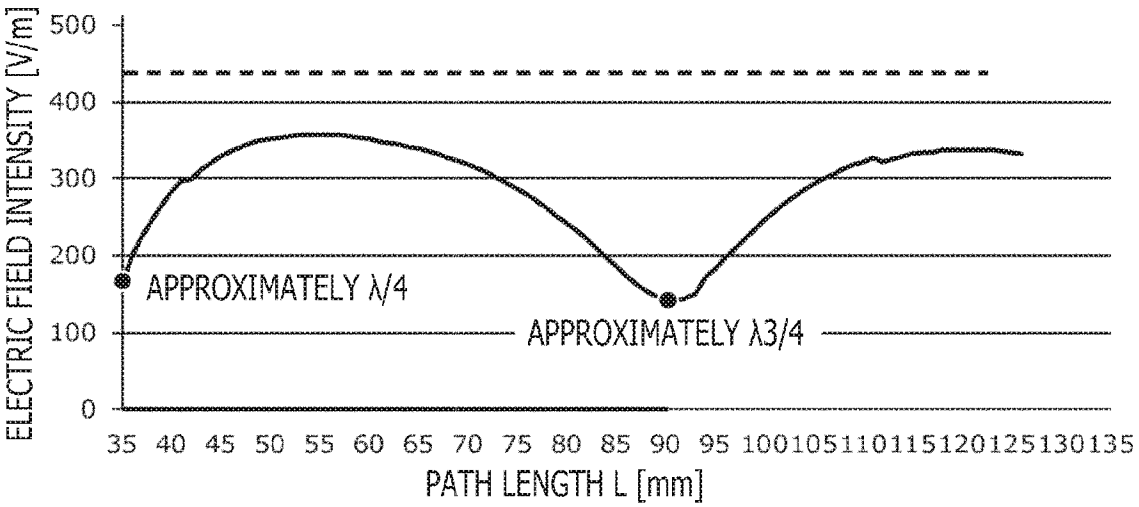
FIG. 4 illustrates a graph indicating the difference in the effect of a conductive body depending on the length of the conductive body.

FIG. 4 illustrates a graph indicating the difference in the effect of the conductive body 30 depending on the path length L and the results of a simulation performed by varying the path length L. The horizontal axis of the graph represents the path length L, and the vertical axis represents the intensity of electromagnetic waves (electric field intensity) generated at a measuring point X when the conductive body 30 is connected to the coaxial cable 20. Here, the measuring point X is 90 mm from the antenna 10. The dashed line in the drawing indicates the electric field intensity at the measuring point X when the conductive body 30 is absent. Note that the communication frequency f of the antenna 10 is 2440 MHz, and the path length L is substantially the same as the electrical length Le.

As illustrated in the drawing, negative peaks at which the electric field intensity is particularly small are observed at path lengths L substantially λ/4 and ¾λ. The electric field intensity is small within the range of ±λ/8 of these negative peaks. However, the electric field intensity is large outside these ranges and not much different from that when the conductive body 30 is absent. Consequently, the conductive body 30 has a significant advantageous effect when the electrical length Le of the conductive body 30 is within ranges at a λ/2 cycle, such as within the range of λ/8 to ⅜λ, ⅜λ to ⅞λ, and so on, as described above.

In the electronic device 1*a* according to the above-described embodiment, the conductive body 30 can be electrically connected to the external conductor of the coaxial cable 20 to suppress radiation of electromagnetic waves from the external conductor of the coaxial cable 20 caused by the influence of the antenna 10. This can prevent the electromagnetic waves from affecting the areas around the coaxial cable 20.

In some cases, the electronic device 1*a* may include a plurality of the antennas 10 and a single RF module 41 controlling the radio communication of the antennas 10. In such a case, even when the antennas 10 are disposed apart from each other, the coaxial cables 20 connecting the antennas 10 and the RF module 41 approach each other near the RF module 41. Thus, the electromagnetic waves generated at the coaxial cables 20 may interfere with each other unless a measure is taken. In the electronic device 1*a* according to the present embodiment, conductive bodies 30 are connected to the coaxial cables 20 to prevent interference of nearby coaxial cables 20 in portions of the coaxial cables 20 closer to the RF module 41 than the conductive bodies 30.

Second Embodiment

An electronic device 1*b* according to a second embodiment of the present invention will now be described with reference to FIG. 5. In the present embodiment, the shape of the conductive body 30 differs from that of the conductive body 30 according to the first embodiment, but the other components are identical to those according to the first embodiment. Thus, components corresponding to those according to the first embodiment are denoted by the same reference signs, and descriptions thereof are omitted. This is also the same for the other embodiments described below.

Figure 5:
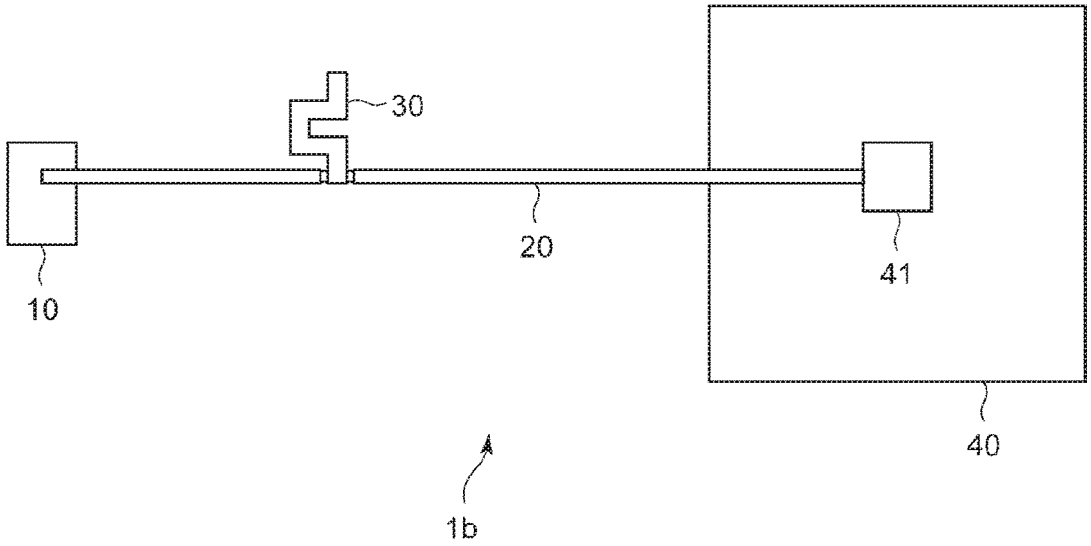
FIG. 5 illustrates the overall internal configuration of an electronic device according to a second embodiment of the present invention.

As illustrated in FIG. 5, the conductive body 30 according to the present embodiment is non-linear and bends at several points to form an overall serpentine shape. In other words, the conductive body 30 has a meander shape. Even with such a shape, the conductive body 30 can suppress radiation of electromagnetic waves from the coaxial cable 20. In the present embodiment also, the path length L of the conductive body 30 is determined such that the electrical length Le approximates (¼+n/2)λ.

In the electronic device 1*b* according to the present embodiment, the conductive body 30 can suppress radiation of electromagnetic waves from the coaxial cable 20, as in the first embodiment. Furthermore, the meander shape of the conductive body 30 allows the open end O to be disposed not too far from the coaxial cable 20 compared to a linear conductive body 30 having the same path length L. Thus, the conductive body 30 occupies a smaller space in the electronic device 1*b*.

Third Embodiment

Figure 6:
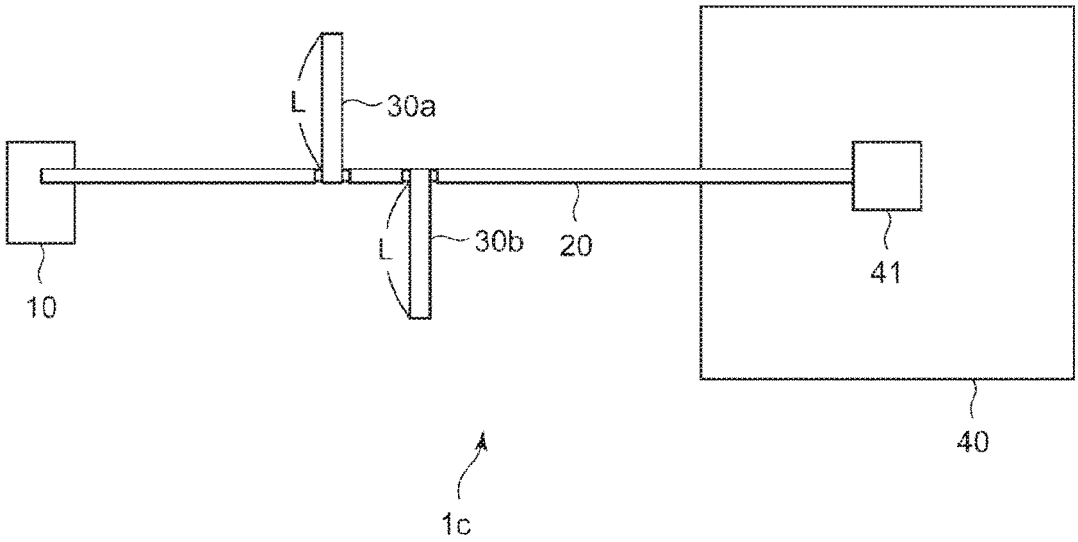
FIG. 6 illustrates the overall internal configuration of an electronic device according to a third embodiment of the present invention.

An electronic device 1*c* according to a third embodiment of the present invention will now be described with reference to FIG. 6. The present embodiment differs from the above-described embodiments in that a plurality of conductive bodies are connected to the external conductor of the coaxial cable 20. In other words, in the present embodiment, two conductive bodies 30 or conductive bodies 30*a* and 30*b* are connected to the external conductor.

The two conductive bodies 30 have the same path length L and are connected to the coaxial cable 20 at different positions. Since the conductive bodies 30*a* and 30*b* have the same path length L, they also have the same electrical length Le. Thus, the conductive bodies 30*a* and 30*b* have an advantageous effect on electromagnetic waves in the same frequency band. A plurality of conductive bodies 30 having the same electrical length in this way can suppress the propagation of leakage currents from the antenna 10 more effectively than a single conductive body 30.

Here, two conductive bodies 30 are connected to the coaxial cable 20. Alternatively, three or more conductive bodies 30 may be connected. Here, the two conductive bodies 30 extend in opposite directions from the coaxial cable 20. Alternatively, the two conductive bodies 30 may be extend in the same direction. Furthermore, the two conductive bodies 30 may be disposed on the coaxial cable 20 at the same distance d from the antenna 10 but extend in different directions.

Fourth Embodiment

Figure 7:
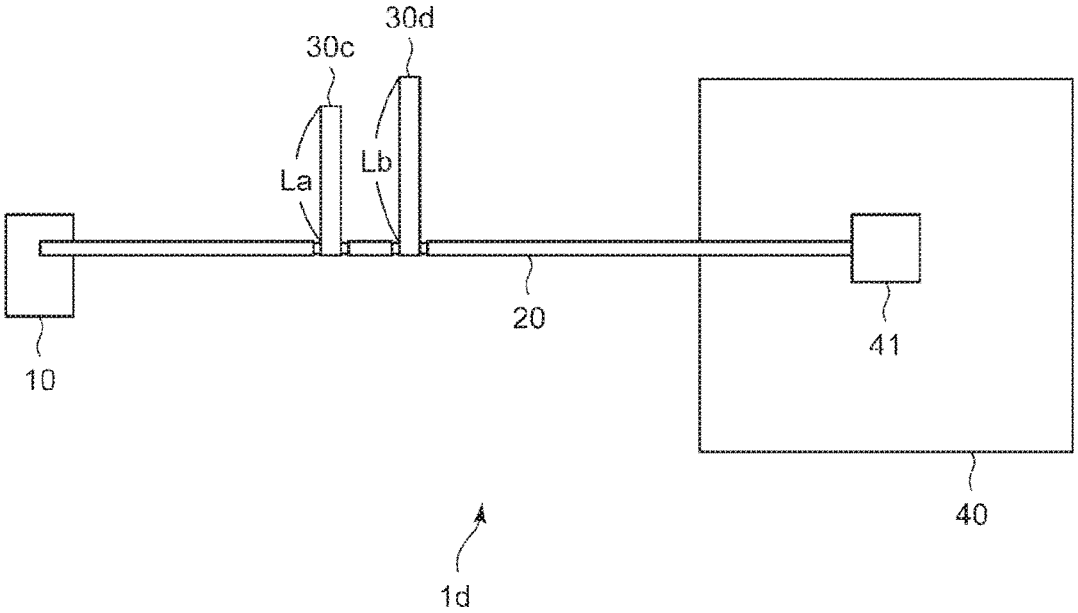
FIG. 7 illustrates the overall internal configuration of an electronic device according to a fourth embodiment of the present invention.

An electronic device 1*d* according to a fourth embodiment of the present invention will now be described with reference to FIG. 7. In the present embodiment, a plurality of conductive bodies 30 is connected to the external conductor of the coaxial cable 20, as in the third embodiment. However, the conductive bodies 30 have different lengths, unlike the third embodiment. In specific, in the present embodiment, a conductive body 30*c* having a path length La and a conductive body 30*d* having a path length Lb are connected to the external conductor of the coaxial cable 20. Here, the electrical lengths of the conductive bodies 30 are the same as the path lengths.

In such a case, the conductive body 30*c* has an advantageous effect on electromagnetic waves having a wavelength four times larger than the path length La. The conductive body 30*d* has an advantageous effect on electromagnetic waves having a wavelength four times larger than the path length Lb. That is, as a whole, radiation of electromagnetic waves of several different wavelengths are suppressed. Thus, in the case where the antenna 10 of the electronic device 1*d* according to the present embodiment is, for example, a multi-resonance antenna having multiple resonance frequencies, leakage currents of multiple frequencies propagating from the antenna 10 can be effectively suppressed.

Here, two conductive bodies 30 are connected to the coaxial cable 20. Alternatively, three or more conductive bodies 30 having different electrical lengths may be connected to the coaxial cable 20. Here, the two conductive bodies 30 extend in the same directions from the coaxial cable 20. Alternatively, the two conductive bodies 30 may be extend in different directions. Furthermore, the two conductive bodies 30 may be disposed on the coaxial cable 20 at the same distance d from the antenna 10 but extend in different directions.

Fifth Embodiment

An electronic device 1*e* according to a fifth embodiment of the present invention will now be described with reference to FIG. 8. In the present embodiment, one conductive body 30 having a bent shape similar to that in the second embodiment is provided. However, the conductive body 30 according to the present embodiment bends only once to form an overall L-shape, unlike the second embodiment. Here, the conductive body 30 bends toward the antenna 10. Hereinafter, the position where the conductive body 30 according to the present embodiment bends is denoted as bending point C.

Figure 8:
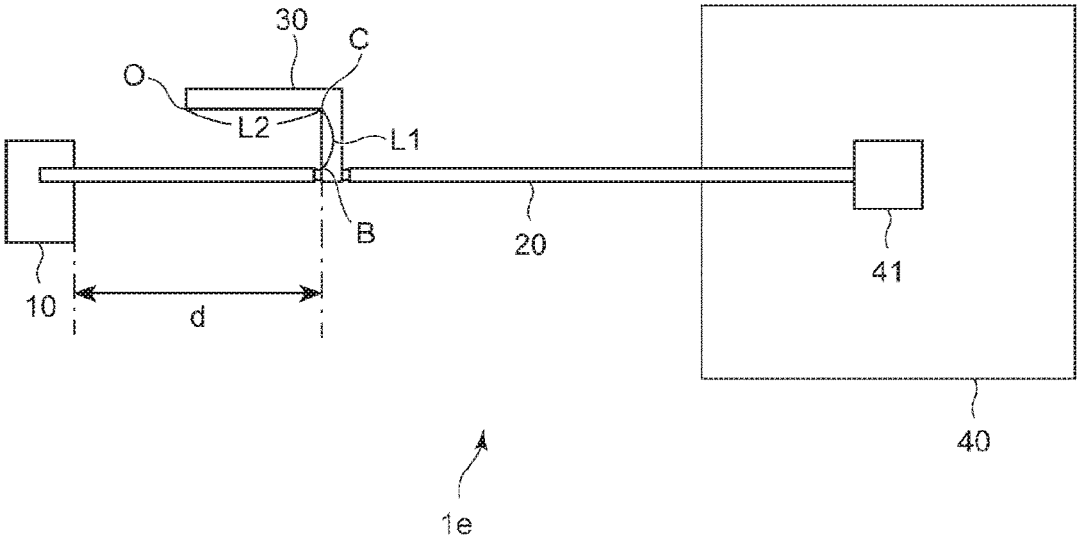
FIG. 8 illustrates the overall internal configuration of an electronic device according to a fifth embodiment of the present invention.

In the present embodiment, the conductive body 30 extends in a direction substantially orthogonal to the extending direction of the coaxial cable 20 from the base point B to the bending point C, as illustrated in FIG. 8. The conductive body 30 bends at a substantially right angle at the bending point C and extends in a direction substantially parallel to the extending direction of the coaxial cable 20 from the bending point C to the open end O. Here, the path length L of the conductive body 30 is defined as L=L1+L2, where L1 is the length from the base point B to the bending point C and L2 is length from the bending point C to the open end O. The path length L is determined in accordance with the communication frequency f of the antenna 10. Here, the length L1 corresponds to the linear distance from the coaxial cable 20 to the open end O.

The effect of the conductive body 30 in this example will now be described on the basis results of a simulation performed under varying conditions. In specific, the inventor varied the length L1 in a stepwise manner while maintaining a constant path length L and varied the connecting points of the conductive body 30 and the coaxial cable 20 (i.e., the distance d from the antenna 10 to the conductive body 30), to study the effect of the conductive body 30.

FIGS. 9A to 9E illustrate the results of studying the effect of the conductive body 30. The drawings illustrate the results of the electric field intensity of the electromagnetic waves radiated from the coaxial cable 20 connected to an antenna 10 having a communication frequency f of 2440 MHz. In the drawings, the path length L of the conductive body 30 is a constant value of 30 mm, which corresponds to approximately ¼ of the wavelength λ corresponding to the communication frequency f.

The horizontal axis in the drawings represents the distance d from the antenna 10 to the conductive body 30, and the vertical axis represents the electric field intensity indicating the intensity of the electromagnetic waves generated at a measuring point X, as in FIG. 4. The dashed line in the drawing indicates the electric field intensity of the electromagnetic waves generated at the measuring point X when the conductive body 30 is absent.

Figure 9A:
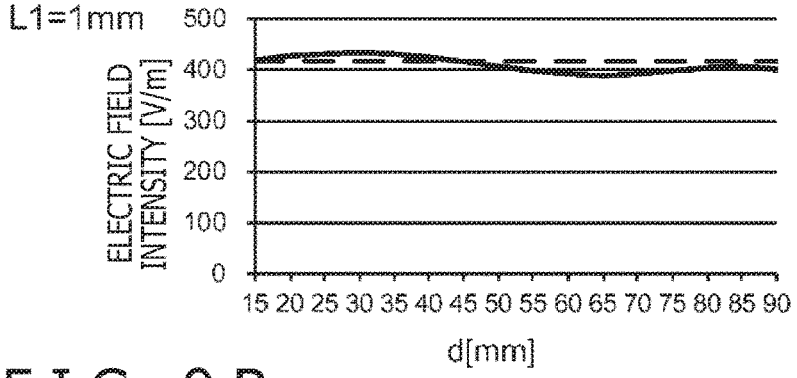
FIG. 9A illustrates a graph indicating an example effect of a conductive body according to the fifth embodiment of the present invention.
Figure 9B:
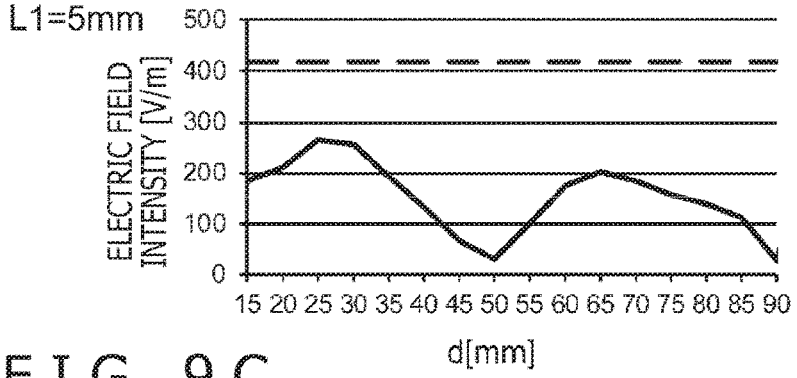
FIG. 9B illustrates a graph indicating another example effect of the conductive body according to the fifth embodiment of the present invention.
Figure 9C:
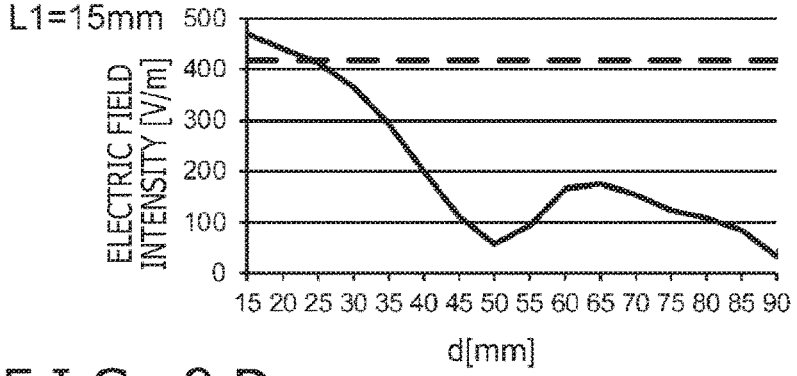
FIG. 9C illustrates a graph indicating another example effect of the conductive body according to the fifth embodiment of the present invention.
Figure 9D:
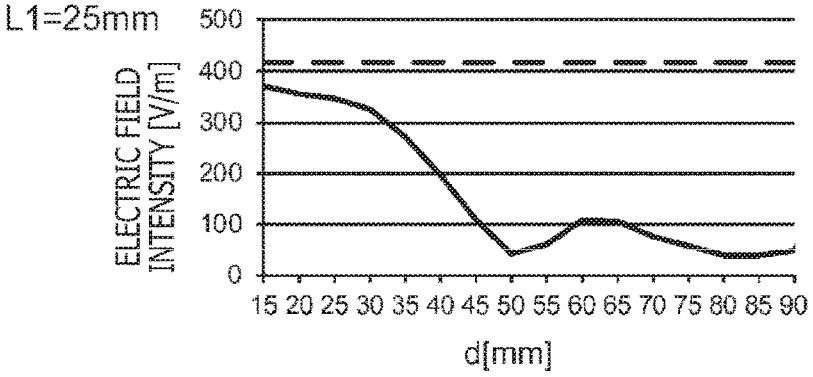
FIG. 9D illustrates a graph indicating another example effect of the conductive body according to the fifth embodiment of the present invention.
Figure 9E:
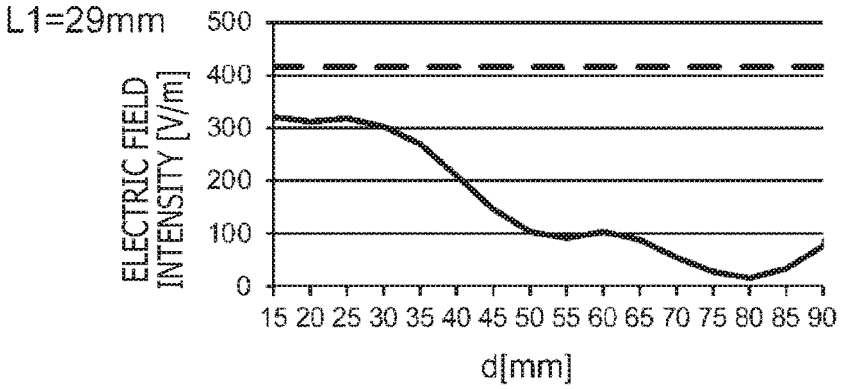
FIG. 9E illustrates a graph indicating another example effect of the conductive body according to the fifth embodiment of the present invention.

The graphs illustrated in FIGS. 9A to 9E indicate the difference in the effect due to a difference in the length L1. In specific, FIG. 9A indicates the results for length L1=1 mm. FIG. 9B indicates the results for length L1=5 mm, FIG. 9C for length L1=15 mm, FIG. 9D for length L1=25 mm, and FIG. 9E for length L1=29 mm. The length L2 is determined by subtracting L1 from L=30 mm.

In the graph in FIG. 9A, substantially no difference was observed in the electric field intensity at the measuring point X when the conductive body 30 was provided (solid line) and when the conductive body 30 was absent (dashed line). Consequently, in the case of a small length L1 and an open end O too close to the coaxial cable 20, a satisfactory effect is not achieved. In contrast, as illustrated in FIG. 9B, in the case of a length L1 of 5 mm, the effect is more significant than the case where the conductive body 30 is absent. The effect of the conductive body 30 is intensified as the length L1 increases such that the open end O is disposed farther from the coaxial cable 20.

Figure 10A:
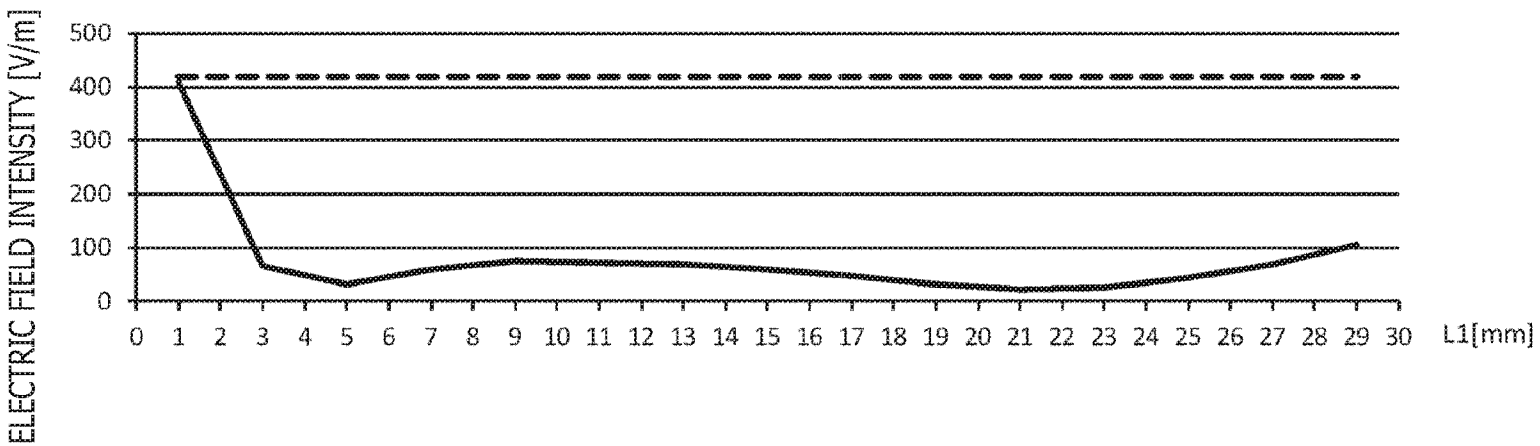
FIG. 10A illustrates a graph indicating another example effect of the conductive body according to the fifth embodiment of the present invention.
Figure 10B:
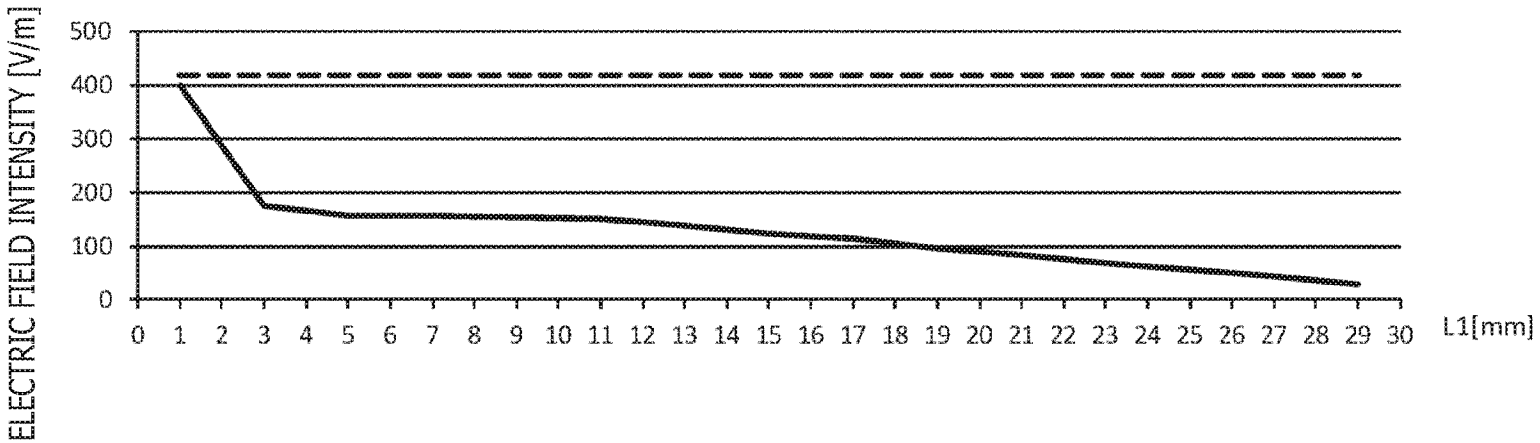
FIG. 10B illustrates a graph indicating another example effect of the conductive body according to the fifth embodiment of the present invention.
Figure 10C:
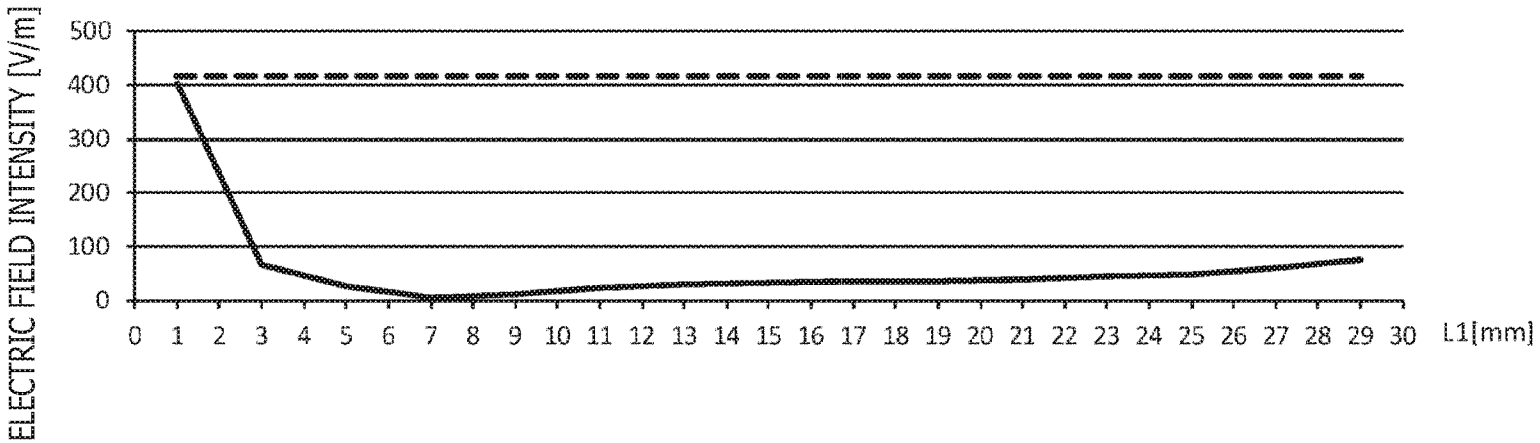
FIG. 10C illustrates a graph indicating another example effect of the conductive body according to the fifth embodiment of the present invention.

FIGS. 10A to 10C illustrate the effect of the conductive body 30 when the distance d was constant and the length L1 was varied. In specific, FIGS. 10A, 10B, and 10C illustrate the electric field intensity at the measuring point X when the distance d was 50 mm, 75 mm, and 90 mm, respectively. With reference to the drawings, the conductive body 30 was not effective when the length L1 was 1 mm, regardless of the distance d, but when the length L1 was increased to 3 mm, the effect of the conductive body 30 was suddenly enhanced. The electric field intensity decreased due to the effect of the conductive body 30 until the length L1 reached 5 mm and then remained substantially the same after that. Consequently, even when the conductive body 30 is bent midway, the open end is preferably disposed at least 3 mm from the coaxial cable 20, more desirably, at least 5 mm.

With reference to FIGS. 9B to 9E, the effect of the conductive body 30 varied also depending on the distance d. In general, when the distance d is λ/4 (=30 mm) or less, the effect of the conductive body 30 was small, but when the connecting position of the conductive body 30 was a certain distance from the antenna 10, the effect of the conductive body 30 increased. Thus, it is preferred that the distance d from the antenna 10 to the connecting position of the conductive body 30 exceed λ/4.

As described above, the shape of the conductive body 30 and the connecting position to the coaxial cable 20 can be appropriately adjusted to increase the effect of the conductive body 30 on suppressing electromagnetic waves.

Sixth Embodiment

An electronic device 1*f* according to a sixth embodiment of the present invention will now be described with reference to FIGS. 11 and 12. In the embodiments described above, the covering of the coaxial cable 20 is removed and the conductive body 30 is directly connected to the exposed external conductor, to electrically couple the conductive body 30 and the external conductor of the coaxial cable 20. However, unlike the embodiments described above, in the present embodiment, the conductive body 30 is disposed outside the covering and near the coaxial cable 20, without removing the covering of the coaxial cable 20. In such a case, the conductive body 30 does not establish a direct electrical connection with the coaxial cable 20 but is electrically coupled to the external conductor through capacitance coupling. In this way, radiation of electromagnetic waves from the coaxial cable 20 can be prevented even when the conductive body 30 is not in a direct electrical connection with the external conductor of the coaxial cable 20.

Figure 11:
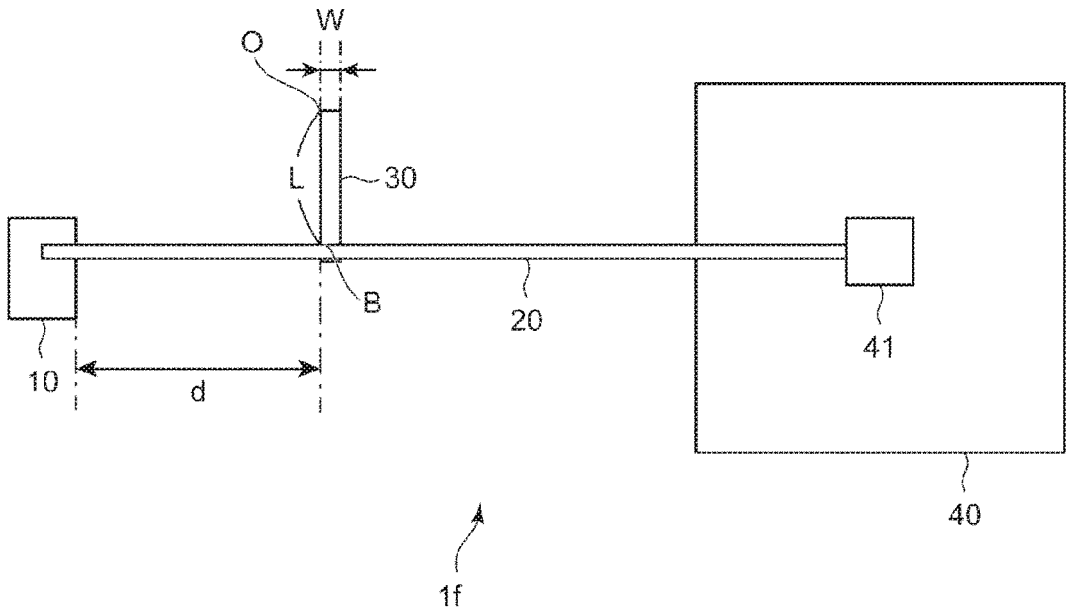
FIG. 11 illustrates the overall internal configuration of an electronic device according to a sixth embodiment of the present invention.

FIG. 11 illustrates the overall internal configuration of the electronic device if according to the present embodiment. FIG. 12 is an enlarged cross-sectional view of the area in which the conductive body 30 is disposed taken along a direction orthogonal to the extending direction of the coaxial cable 20. With reference to FIG. 12, the coaxial cable 20 includes a signal line 20*d* passing through the center, a dielectric body 20*c* disposed between the signal line 20*d* and an external conductor 20*b*, and a covering 20*a* disposed around the external conductor 20*b*. In the present embodiment, the covering 20*a* of the coaxial cable 20 is not removed, and the coaxial cable 20 and the conductive body 30 overlaps each other in plan view. As a result, the conductive body 30 establishes capacitance coupling with the external conductor 20*b* of the coaxial cable 20 across the covering 20*a*.

Figure 12:
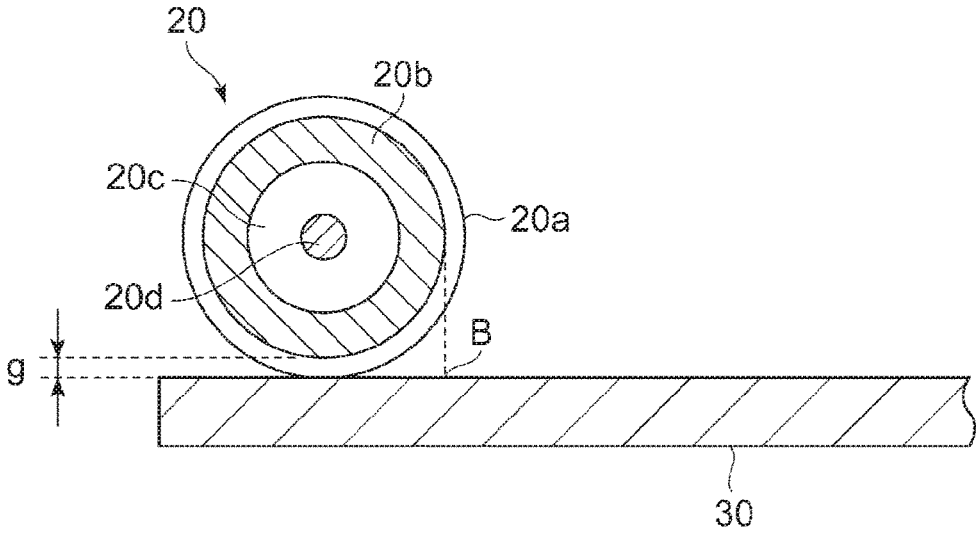
FIG. 12 is an enlarged cross-sectional view of the positional relation between a coaxial cable and a conductive body according to the sixth embodiment.

In FIG. 12, the conductive body 30 is in contact with the covering 20*a*. Alternatively, the conductive body 30 may be disposed apart from the covering 20*a*. However, it is preferred that a gap g between the conductive body 30 and the external conductor 20*b* be minimized to establish capacitance coupling between the conductive body 30 and the external conductor 20*b*.

Figure 13:
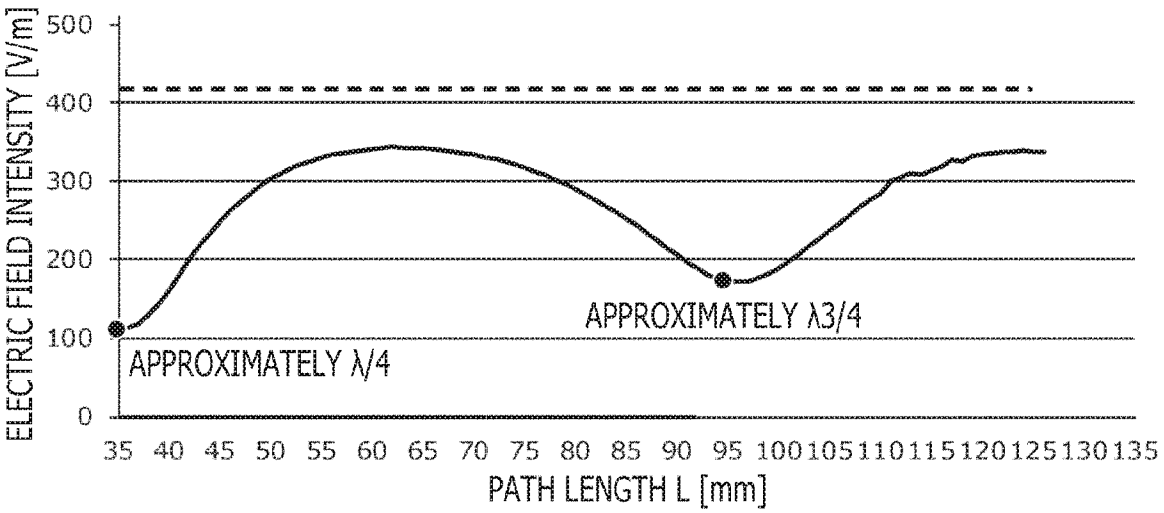
FIG. 13 illustrates a graph indicating an example effect of the conductive body according to the sixth embodiment of the present invention.

FIG. 13 illustrates a graph indicating the difference in the effect of the conductive body 30 according to the present embodiment depending on the path length L. Similar to FIG. 4, the horizontal axis of the graph represents the path length L, and the vertical axis represents the intensity of the electromagnetic waves (electric field intensity) generated at a measuring point X (d=90 mm). The dashed line in the drawing indicates the electric field intensity at the measuring point X when the conductive body 30 is absent. Note that, in the drawing, the communication frequency f of the antenna 10 is 2440 MHz, and the path length L is substantially the same as the electrical length Le.

As illustrated in FIG. 13, when the conductive body 30 is electrically coupled to the external conductor 20*b* of the coaxial cable 20 through capacitance coupling, negative peaks of the electric field intensity are observed at positions substantially corresponding to the path lengths L of $\lambda/4$ and $3/4\lambda$. Consequently, in the present embodiment, the effect of the conductive body 30 on suppressing electromagnetic waves is enhanced when the electrical length Le is within the range of $(1/8+n/2)\lambda \leq Le \leq (3/8+n/2)\lambda$, where n is an integer larger than or equal to zero.

Figure 14:
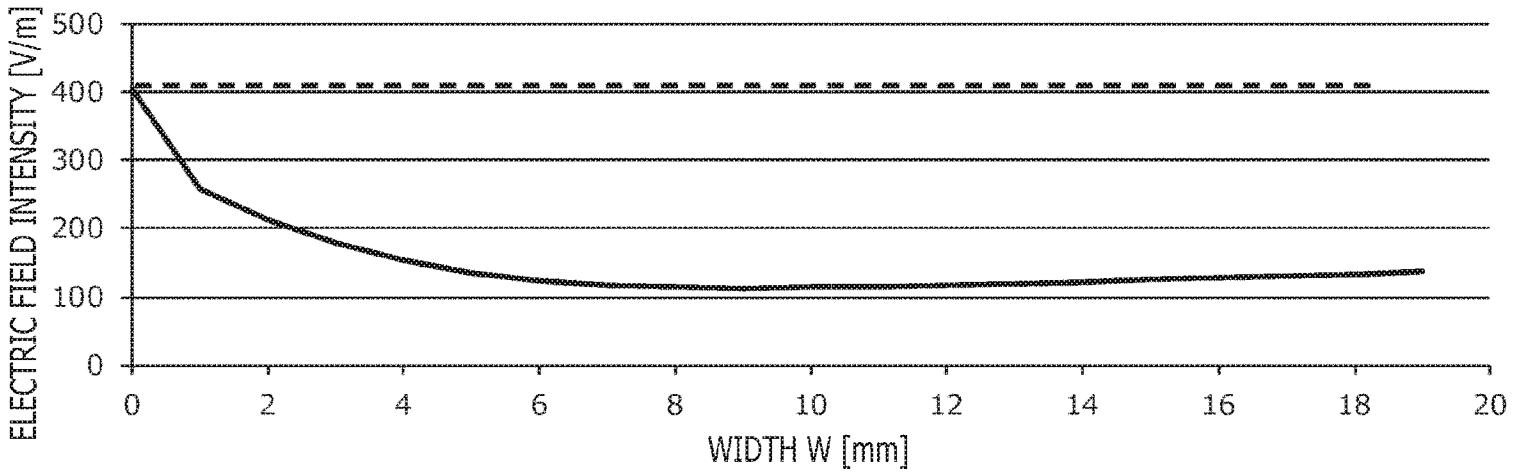
FIG. 14 illustrates a graph indicating an example effect of the conductive body according to the sixth embodiment of the present invention.

In the present embodiment, the width W in the lateral direction (a direction parallel to the extending direction of the coaxial cable 20) of the conductive body 30 should be large enough to establish capacitance coupling of the conductive body 30 and the external conductor 20*b*. FIG. 14 illustrates a graph indicating the difference in the effect of the conductive body 30 depending on the width W. The vertical axis represents the electric field intensity at the measuring point X, and the horizontal axis represents the width W of the conductive body 30. The dashed line indicates the electric field intensity when the conductive body 30 is absent. As illustrated in the drawing, the width W of the conductive body 30 is preferably 2 mm or more, more preferably, 6 mm or more.

Figure 15:
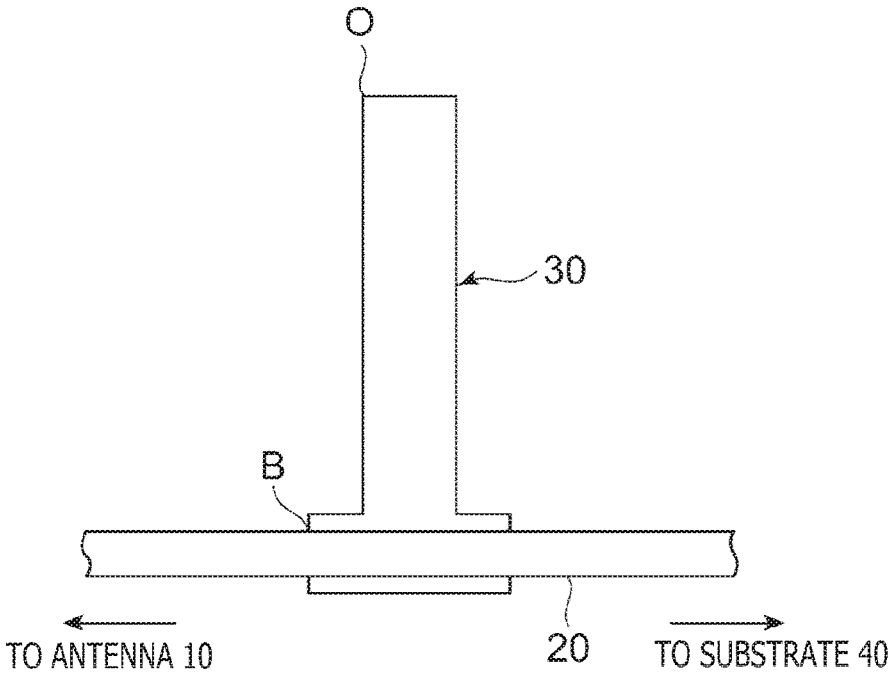
FIG. 15 illustrates the shape of a conductive body according to a modification.

In the embodiments described above, the width W of the conductive body 30 is constant. Alternatively, the width W of the conductive body 30 may not be constant. In particular in the sixth embodiment, the width W of the conductive body 30 should be large at the position overlapping with the coaxial cable 20, as described above. Thus, the width W of the conductive body 30 at the position overlapping with the coaxial cable 20 may be large, and the width W of other portions may be relatively small. FIG. 15 illustrates the shape of such a conductive body 30 according to a modification.

Figure 16:
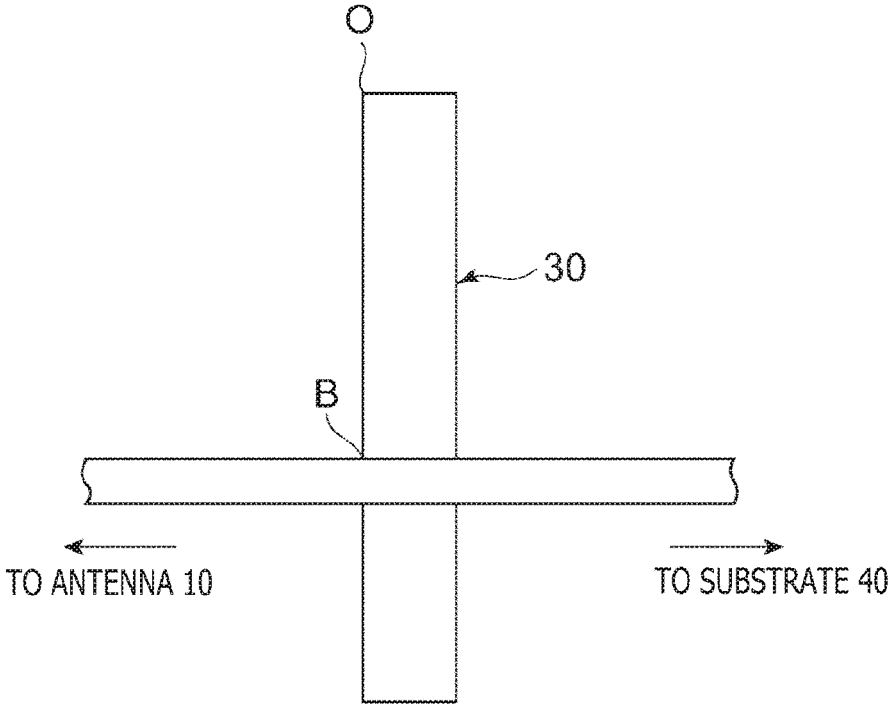
FIG. 16 illustrates the shape of a conductive body according to another modification.

In the embodiments described above, an end of the conductive body 30 opposite the open end O is electrically coupled to the coaxial cable 20. Alternatively, a midway position of the conductive body 30 may be electrically coupled to the coaxial cable 20. FIG. 16 illustrates an example position of the conductive body 30 in such a case. In this example, the external conductor 20*b* of the coaxial cable 20 and the conductive body 30 establish capacitance coupling at a position overlapping in plan view. In this example, the end portion opposite the open end O also is effective in suppressing electromagnetic waves having a wavelength corresponding to the length of the end portion.

Figure 17:
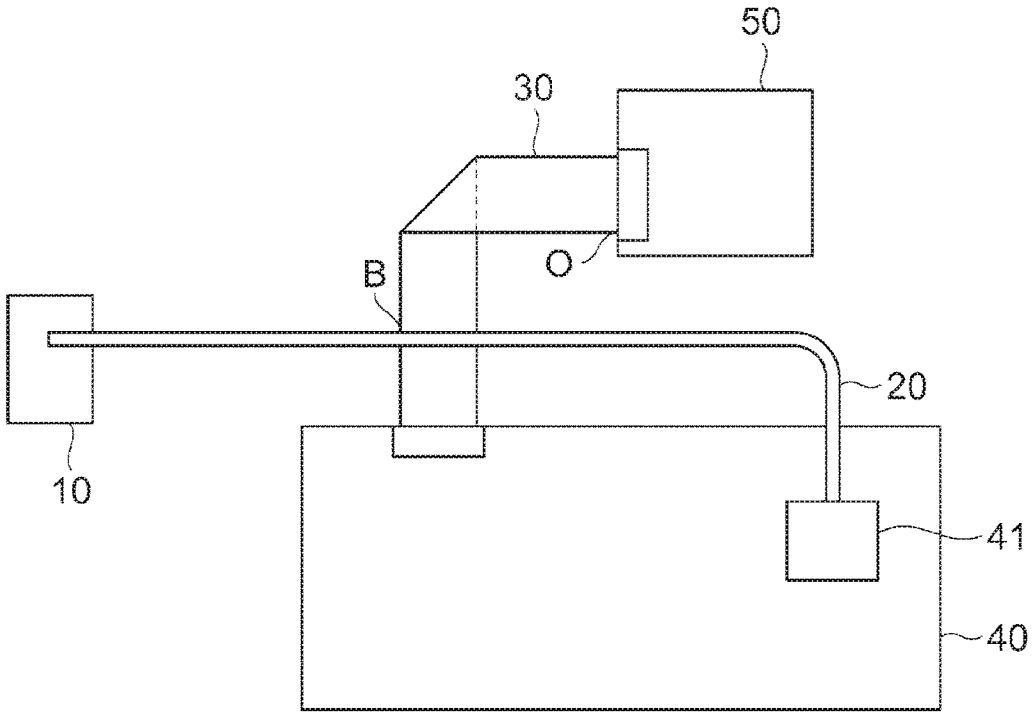
FIG. 17 illustrates an example in which a flexible cable functions as a conductive body.

In particular, in the sixth embodiment, a cable connected to the ground of the substrate 40 can function as the conductive body 30 because the conductive body 30 is not electrically connected to the external conductor 20*b* of the coaxial cable 20. FIG. 17 illustrates an example position of the conductive body 30 in such a case. In this example, the conductive body 30 is a flexible cable. Unlike the case illustrated in FIG. 16, the end of the conductive body 30 opposite the open end O is connected to a connecter provided on the substrate 40. In this way, the end of the conductive body 30 opposite the open end O is connected to the ground of the substrate 40 connected to the coaxial cable 20. The open end O of the conductive body 30, which is folded once, is connected to a circuit board in a peripheral device 50. In other words, the flexible cable functioning as the conductive body 30 connects the electronic circuits in the substrate 40 and the peripheral device 50.

In this example, the ground of the circuit board of the peripheral device 50 is electrically separated from the ground of the substrate 40. Thus, the open end O of the conductive body 30 is not electrically connected to the ground of the substrate 40 connected to the coaxial cable 20 and thus prevents propagation of electromagnetic waves having a wavelength $\lambda$ corresponding to the path length L, in view of the coaxial cable 20. In this way, a cable overlapping the coaxial cable 20 functions as the conductive body 30 if one end of the cable functions as an open end O not electrically connected to the ground connected to the coaxial cable 20. In such a case, the end of the conductive body 30 opposite the open end O may be electrically connected to the ground connected to the coaxial cable 20.

Note that the embodiments of the present invention are not limited to those described above. For example, in the descriptions above, the antenna 10 performs radio communication in accordance with a wireless LAN standard or a Bluetooth standard. Alternatively, the conductive body may be connected to a coaxial cable connected to an antenna of any other type besides those described above. Furthermore, the conductive body may be provided in any number or shape besides those described above to achieve similar advantageous effects.

The aspects of multiple embodiments described above may be combined and applied to a single electronic device. For example, in the third and fourth embodiments described above, some or all conductive bodies 30 may have a meander shape. Furthermore, in the sixth embodiment, multiple conductive bodies 30 electrically coupled to the coaxial cable 20 through capacitance coupling may be provided, and the conductive bodies 30 may have an L-shape or a meander shape.

REFERENCE SIGNS LIST

1*a*, 1*b*, 1*c*, 1*d*, 1*e*, if Electronic device, 10 Antenna, 20 Coaxial cable, 30 Conductive body, 40 Substrate, 41 Communication module, 50 Peripheral device.

The invention claimed is:

1. An electronic device comprising:

a coaxial cable connected to an antenna; and at least one conductive body having a strip-like shape and electrically coupled to an external conductor of the coaxial cable, one end of the conductive body not being electrically connected to a ground connected to the coaxial cable, wherein an electrical length (Le) of the at least one conductive body from a position where the at least one conductive body is coupled to the external conductor to the one end is defined by the formula: $Le=(1/8+n/2)\lambda$ to $(3/8+n/2)\lambda$ inclusive, where $\lambda$ is a wavelength of electromagnetic waves corresponding to a communication frequency of the antenna and n is an integer larger than or equal to zero, wherein the at least one conductive body having a length Le is configured to suppress electromagnetic radiation on the coaxial cable.

2. The electronic device according to claim 1, wherein the at least one conductive body located at a position overlapping the coaxial cable is electrically coupled to the external conductor across a covering of the coaxial cable through capacitance coupling.

3. The electronic device according to claim 2, wherein a width of the at least one conductive body at the position where the at least one conductive body overlaps the coaxial cable along an extending direction of the coaxial cable is 2 mm or more.

4. The electronic device according to claim 2, wherein the at least one conductive body includes a cable, an end opposite the one end is connected to a ground connected to the coaxial cable.

5. The electronic device according to claim 1, wherein the at least one conductive body extends in a direction substantially orthogonal to the extending direction of the coaxial cable at a position where the at least one conductive body is coupled to the coaxial cable.

6. The electronic device according to claim 1, wherein the at least one conductive body has a linear shape.

7. The electronic device according to claim 1, wherein the at least one conductive body has a bent shape in a midway.

8. The electronic device according to claim 1, wherein the at least one conductive body includes a plurality of conductive bodies each having a strip-like shape and electrically coupled to the external conductor of the coaxial cable.

9. The electronic device according to claim 1, wherein the one end of the at least one conductive body is disposed at a distance of 3 mm or more from the coaxial cable.

10. The electronic device according to claim 1, wherein a length of the coaxial cable between a position where the at least one conductive body is coupled to the coaxial cable and the antenna is more than one fourth of the wavelength of the electromagnetic waves corresponding to a communication frequency of the antenna.

11. The electronic device according to claim 1, wherein the conductive body is disposed between the antenna and a substrate, and the coaxial cable connects the antenna to an RF module mounted on the substrate.

* * * * *